US005137865A

United States Patent [19]

Matsuda et al.

[11] Patent Number: 5,137,865

[45] Date of Patent: Aug. 11, 1992

[54] METHOD FOR THERMAL DYE TRANSFER PRINTING, DYE TRANSFER SHEETS AND METHOD FOR MAKING SAME, DYE RECEIVING SHEETS AND A THERMAL PRINTING SYSTEM

[75] Inventors: Hiromu Matsuda; Tetsuji Kawakami; Keiichi Yubakami, all of Osaka; Akihiro Imai; Nobuyoshi Taguchi, both of Ikoma, all of Japan

[73] Assignee: Matsushita Electric Industrial Co., Ltd., Osaka, Japan

[21] Appl. No.: 318,588

[22] Filed: Mar. 3, 1989

[30] Foreign Application Priority Data

| | | | |
|---|---|---|---|
| Mar. 4, 1988 | [JP] | Japan | 63-51930 |
| Jun. 10, 1988 | [JP] | Japan | 63-144242 |
| Jun. 10, 1988 | [JP] | Japan | 63-144243 |
| Jun. 10, 1988 | [JP] | Japan | 63-144244 |

[51] Int. Cl.[5] ..... B41M 5/035; B41M 5/26

[52] U.S. Cl. ..... 503/227; 428/195; 428/212; 428/913; 428/914

[58] Field of Search ..... 8/471; 427/146, 256; 428/195, 913, 914; 503/227

[56] References Cited

U.S. PATENT DOCUMENTS

| | | | |
|---|---|---|---|
| 4,724,288 | 2/1988 | Hann | 503/227 |
| 4,880,768 | 11/1989 | Mochizuki et al. | 503/227 |
| 4,902,669 | 2/1990 | Matsuda et al. | 503/227 |

FOREIGN PATENT DOCUMENTS

| | | | |
|---|---|---|---|
| 1049894 | 3/1986 | Japan | 503/227 |
| 1148095 | 7/1986 | Japan | 503/227 |
| 63-27291 | 2/1988 | Japan | 503/227 |

OTHER PUBLICATIONS

H. Matsuda et al., "Partially Reusable Printing Characteristics of Dye Transfer Type Thermal Printing Sheets" in Collected Papers of Proceedings of 2nd Non-impact Printing Technologies Symposium, pp. 101-104 (1985).

T. Shimizu et al., "Multi-Usable Sublimation Dye Sheets" National Convention Record of the Institute of Image Electronics Engineers (Jun. 1986) pp. 1-4.

H. Matsuda et al., "Multi-Usable Dye Transfer Sheets" Advanced Printing of Paper Summaries of the 30th Anniversary Conference of the Society of Electrophotography of Japan, pp. 266-269.

*Primary Examiner*—Bruce H. Hess

*Attorney, Agent, or Firm*—Lowe, Price, LeBlanc & Becker

[57] ABSTRACT

Thermal dye transfer printing systems which are adapted for multiple-use printing modes wherein one dye transfer sheet is repeatedly used and which comprise a dye transfer sheet having, on a substrate, a dye transfer layer containing a sublimable dye and a binder resin and a dye receiving sheet having a dye receiving layer which has a diffusion rate of the dye smaller than the dye transfer layer. This is effective in suppressing a lowering of printing density owing to the increase in number of printing cycles using one dye transfer sheet. Alternatively, the dye transfer sheet is constituted such that the dye transfer layer is made of a plurality of sub-layers in which the concentration of the dye decreases from the sub-layer formed directly on the substrate toward the surface side of the dye transfer layer. The dye is invariably supplied from the higher concentration sub-layers to ensure full color printing with a remarkably increasing number of multiple-use printing cycles.

26 Claims, 4 Drawing Sheets

METHOD FOR THERMAL DYE TRANSFER PRINTING, DYE TRANSFER SHEETS AND METHOD FOR MAKING SAME, DYE RECEIVING SHEETS AND A THERMAL PRINTING SYSTEM

BACKGROUND OF THE INVENTION

1. Field of the Invention

This invention relates to the art of thermal dye transfer printing wherein a sublimable dye of a dye transfer sheet is transferred to a dye receiving sheet in an imagewise pattern and more particularly, to a thermal dye transfer method and a thermal printing system of the type which comprises dye transfer sheets using sublimable dyes and dye receiving sheets in combination and which is adapted for multiple copying or printing wherein the dye transfer sheet is repeatedly used while the dye receiving sheet is in single use or the transfer sheet is run at a speed of 1/n, where n>1, of the dye receiving sheet. The invention also relates to the dye transfer sheet used in the above system, and to a method for making the dye transfer sheet.

2. Description of the Prior Art

The thermal dye transfer printing systems using sublimable dyes are full color hard copy printing systems where printing with a density graduation for each printing dot is possible. However, dye transfer sheets having a sublimable dye layer are expensive. Many attempts have been made to utilize the dye transfer sheet repeatedly several to ten and several tens times for reduction of the costs. This multiple-use multi-usable mode printing where the dye transfer sheet is repeatedly used several to ten and several times has been reported, for example, in (1) "Partially Reusable Printing Characteristics of Dye Transfer-type Thermal Printing Sheets" in Proceedings of 2nd Non-impact Printing Technologies Symposium, pp. 101 to 104 (1985) and (2) "<ulti-usable Sublimation Dye Sheets" in National Convention Record of the Institute of Image Electronics Engineers (June, 1986). The above reports (1) and (2) deal with the printing characteristics in the multiple-use mode determined by a relative speed system where the dye transfer sheet is moved at a speed, relative to a thermal printing head, smaller than the dye receiving sheet. Broadly, the multiple-use mode printing includes a simple repetition technique where one dye transfer sheet is repeatedly applied at n times where n>1, and an n-times mode relative speed technique where the moving speed of the dye transfer sheet is 1/n of that of the dye receiving sheet, thus the dye transfer sheet being repeatedly utilized substantially n times. The relative speed system should permit the dye transfer sheet and the dye receiving sheet to move smoothly since these sheets are fed at different speeds. Since, however, a fresh portion of the dye transfer sheet is invariably supplied for the printing, the possible number of the repetitions in use of the dye transfer sheet becomes larger than that of the simple repetition system.

In the report (1), spherical spacer particles are provided between the dye transfer sheet and the dye receiving sheet, by which it is realized that at the repetition of n=12, a printing density is about 1.8. The report (2) states that the dye transfer sheet and the dye receiving sheet are in contact with each other to attain a printing density of about 1.0 at n=10.

In order to reproduce full color hard copies whose quality is similar to that of the hard copies obtained by ordinary single-use printing, it is required that the saturation printing density be substantially equal to that attained by the ordinary single-use printing and be in the range of about 1.5 to 1.8 and that the variation in printing density during the repetition of the printing operations be as small as possible when the same level of printing energy is applied for the respective operations so as to avoid an adverse influence as would be produced by the multiple-use mode printing.

With the above prior art (1), when the dye is provided in an amount sufficient for the multiple-use mode printing, the above requirements are satisfied with respect to the printing characteristics. However, it is necessary to provide a space between the dye transfer sheet and the dye receiving sheet. This imposes limitation on the type of dye which can be used in this system, i.e. the dye should have a high degree of sublimation. However, highly sublimable dyes generally involve the problem in practical applications that they are very poor in weatherability such as optical fading properties and fading in the dark. If a dye having a low degree of sublimation and thus high weatherability is applied to a system of the prior art (1), the printing density lowers considerably and thus, an intended printing density cannot be obtained. In the prior art (2), it is possible to use a dye of high weatherability and a low degree of sublimation since the dye transfer is effected under contacting conditions. However, the dye is used in an amount sufficient for multiple-use mode printing under which when printing is repeated at the same level of printing energy, the printing density greatly lowers as the number of repetitions increases. In addition, the printing density obtained by this mode printing does not reach a practically satisfactory level.

SUMMARY OF THE INVENTION

It is accordingly an object of the invention to provide a method for thermal dye transfer printing which can solve the prior art problems and wherein a dye transfer sheet using a sublimable dye and a dye receiving sheet are used in contact with each other in such a way that either a dye transfer sheet is repeatedly used at least several times or the dye transfer sheet is moved at a smaller speed relative to a thermal printing head than the dye receiving sheet, under which a lowering in printing density on the dye receiving sheet becomes very small when the printing operations are repeated at the same level of printing energy.

It is another object of the invention to provide a method for thermal dye transfer printing which ensures a high saturation printing density by multiple-use mode printing where any arbitrary portions of a sublimable dye transfer sheet may be repeatedly used for printing without a significant reduction of printing density.

It is a further object of the invention to provide a method for thermal dye transfer printing which can significantly improve multiple-use mode printing characteristics substantially equal to those of a single-use mode printing procedure where any portions of a dye transfer layer of a dye transfer sheet are used only once.

It is a still further object of the invention to provide a combination of a dye transfer sheet having a sublimable dye transfer layer and a dye receiving sheet whereby the dye transfer sheet can be repeatedly used for realizing the multiple-use mode printing.

It is another object of the invention to provide a dye transfer sheet using sublimable dyes which is particularly suitable for multiple-use mode printing.

According to one embodiment of the invention, there is provided a method for thermal dye transfer printing which comprises:

providing a dye transfer sheet having a substrate and a dye transfer layer formed on the substrate and comprised of a sublimable dye and a binder resin and a dye receiving sheet having on a substrate a dye receiving layer capable of receiving the sublimable dye of an imagewise pattern from the dye transfer sheet, the dye receiving layer permitting diffusion of the sublimable dye therethrough at a rate smaller than a diffusion rate of the sublimable dye in the dye transfer layer;

contacting the dye transfer sheet and the dye receiving sheet so that the dye transfer layer and the dye receiving layer are facing each other;

heating the contacted sheets in an imagewise pattern to cause the sublimable dye to transfer to the dye receiving layer according to the imagewise pattern to form an image on the dye receiving sheet; and repeating the above contacting and heating steps for a plurality of subsequent printing operation cycles wherein the dye transfer sheet is reused for printing on fresh dye receiving sheets whereby the dye transfer layer is repeatedly used plural times at any arbitrary portions thereof.

The heating may be effected either from the side of the dye transfer sheet which is opposite to the dye transfer layer or from the layer-free side of the dye receiving sheet.

According to another embodiment of the invention, there is also provided a method for thermal dye transfer printing which comprises:

providing a dye transfer sheet having a substrate and a dye transfer layer formed on the substrate and comprised of a sublimable dye and a binder resin wherein the concentration by weight of the sublimable dye in the layer is lower at the surface side of the layer than at the side contacting the substrate and a dye receiving sheet having on a substrate a dye receiving layer capable of receiving the sublimable dye of an imagewise pattern from the dye transfer sheet;

contacting the dye transfer sheet and the dye receiving sheet so that the dye transfer layer and the dye receiving layer are facing each other;

heating the contacted sheets in an imagewise pattern to permit the sublimable dye to transfer to the dye receiving layer according to the imagewise pattern to form an image on the dye receiving sheet; and repeating the above contacting and heating steps for a plurality of subsequent printing operation cycles wherein the dye transfer layer is reused for subsequent printing on fresh dye receiving sheets whereby the dye transfer layer is repeatedly used plural times at any arbitrary portions thereof. Preferably, the lowering in the concentration of the sublimable dye in the dye transfer sheet is realized by forming at least two sub-layers on the substrate so that the concentration of the sublimable dye in one of the sub-layers contacting the substrate is higher than that in the other sub-layer.

In a preferred embodiment, the above two embodiments are used in combination. More particularly, a dye transfer sheet having a dye transfer layer which contains a sublimable dye at a concentration decreasing from the side contacting the substrate toward the surface side of the dye transfer layer is used in combination with a dye receiving sheet having a dye receiving layer which permits diffusion of the sublimable dye therethrough at a rate smaller than a diffusion rate of the sublimable dye in the dye transfer layer.

According to a further embodiment of the invention, there is provided a thermal dye transfer printing system which comprises a dye transfer sheet which is used in combination with a dye receiving sheet. The dye transfer sheet comprises a substrate and a dye transfer layer formed on the substrate and comprised of a sublimable dye and a binder resin in such a way that the content of the sublimable dye in the dye transfer layer is lower at the surface side thereof than at the side contacting the substrate. The varying content is realized by forming at least two sub-layers in such a way that one of the sub-layers contacting the substrate has a content of the sublimable dye higher than the other sub-layers. Needless to say, a plurality of sub-layers may be formed to have a decreasing content of the sublimable dye from the side contacting the substrate toward the surface side. The uppermost sub-layer may be substantially free of any dye therein. This system is particularly useful in multiple mode printing wherein the dye transfer sheet is repeatedly used at any arbitrary portions of the dye transfer layer for printing. It is important to note that the dye dye transfer sheet used in the methods and the system of the invention can be repeatedly used plural times at any arbitrary portions of the dye transfer layer and provide a satisfactory printing density in each printing cycle. More specifically, once and subsequently used portions of the dye transfer layer can be reused for subsequent printing cycles in a simple repetition mode procedure. In an n-times relative speed mode procedure, the same portions of the dye transfer layer are repeatedly used while shifting little by little a zone of the transfer layer being used for printing. The term "repeatedly used at any arbitrary portions of the dye transfer layer" means that in either mode, arbitrary portions of the dye transfer layer stand repeated use.

DETAILED DESCRIPTION AND EMBODIMENTS OF THE INVENTION

Figure 1:
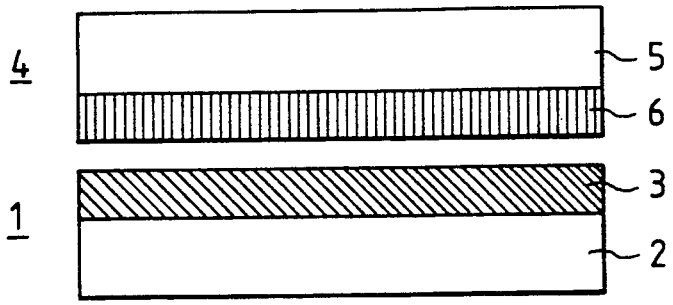
FIG. 1 is a schematic side view of a combination of a dye transfer sheet and a dye receiving sheet for illustrating a thermal printing method according to one embodiment of the invention.

The thermal printing methods of the invention are first described.

In one embodiment of the invention, there is provided a method in which a dye transfer sheet and a dye receiving sheet are contacted with each other and heated in an imagewise manner to transfer a sublimable dye contained in a dye transfer layer of the transfer sheet on a dye receiving layer of the dye receiving sheet. Under contacting conditions, the dye transfer is predominantly controlled by a diffusion phenomenon of the sublimable dye occurring between the dye transfer layer and the dye receiving layer.

Attention is directed to how the diffusion rates of a sublimable dye in the insides of the dye transfer layer and the dye receiving layer influence transfer characteristics of the dye from the dye transfer layer in the dye receiving layer during multiple-use printing cycles. If the rate of diffusion in the dye transfer layer is equal to or smaller than the rate of diffusion in the dye receiving layer, the rate of transfer of the dye from the dye transfer layer surface toward the dye receiving layer becomes greater than a rate of supply of the dye from the inside to the surface of the dye transfer layer. The dye present near the surface of the dye transfer layer is first consumed. In this state, as the printing is repeated, the concentration of the dye in the vicinity of the surface of the dye transfer layer continues to reduce sharply. At the same level of energy being applied, the amount of the dye transferred to the dye receiving layer abruptly reduces, with a considerable lowering of printing density. Accordingly, the rate of diffusion of the dye through the dye transfer layer is made greater than a rate of diffusion of the dye in the dye receiving layer. This means that the rate of supply of the dye from the inside toward the surface of the dye transfer layer becomes greater than a rate of transfer from the dye transfer layer surface to the dye receiving layer. The dye dispersed throughout the dye transfer layer can be efficiently consumed. Thus, the lowering in concentration of the dye in the surface of the dye transfer layer accompanied by the repeated use of the dye transfer sheet can be suppressed, with an improved print density after repetition of the printing cycle.

The method according to the first embodiment of the invention is based on the above concept. The diffusion rates in the dye transfer layer and the dye receiving layer whose diffusion rate of a sublimable dye is defined to be smaller than that of the dye transfer layer can be qualitatively compared by the following procedure.

When diffusion rates of a dye in resins A and B are compared with each other, dye receiving sheets having dye receiving layers which make use of the resins A and B, respectively, are fabricated. Separately, a dye transfer sheet wherein a dye transfer layer having an intended dye is formed on a support is fabricated. This dye transfer sheet is commonly used for the dye receiving sheets, and transfer printing is practiced to check print densities on the respective dye receiving sheets. More specifically, an amount of the transferred dye on the respective receiving layers is measured by spectrophotometric determination through extraction of the dye. A resin having a higher diffusion rate results in a higher print density or a higher amount of the transferred dye. In general, a resin having a lower heat resistance or a smaller intermolecular force becomes higher in the diffusion rate, i.e. with a resin having a higher heat resistance or higher intermolecular force, its diffusion rate is lower. If the ratio in the diffusion rate between the dye transfer layer and the dye receiving layer is made higher within a range where the dye transfer layer does not involve any problem with respect to the preservation and printing sensitivity, the rate of supply of the dye from the inside of the dye transfer layer toward the surface is faster relative to the transfer rate from the dye transfer layer surface toward the dye receiving layer. In this state, the print density during repetitions of the multiple-use printing operations does not lower significantly.

Although the details of the dye transfer sheet and the dye receiving sheet will be described hereinafter, the dye receiving layer used in this embodiment should preferably comprise a cured resin which has a crosslinking structure and is capable of suppressing diffusion of a sublimable dye. If the cured resin is used in combination with thermoplastic resins, the cured resin should be contained in an amount of not less than 25 wt % of the combination. Similarly, a water-soluble resin is effective in suppressing diffusion of a sublimable dye. This is because water-soluble resins have generally polar groups in large amounts and thus a great intermolecular force, so that the diffusion rate of the dye can be suppressed at a low level. If the water-soluble resin is used in combination with a water-dispersable resin, it is used in an amount of not less than 25 wt % of the combination.

Reference is now made to the accompanying drawings in which like reference numerals indicate like members or parts and particularly, to FIG. 1. In the figure, there is generally shown a dye transfer sheet 1 which includes a substrate 2 and a dye transfer layer 3. Over the transfer sheet 1 is indicated a dye receiving sheet 4 which has a substrate 5 and a dye receiving layer 6 formed on one side of the substrate 5. The dye transfer layer 3 and the dye receiving layer 6 are facing each other.

In the method of the invention, after the provision of the combination of both sheets, the sheets are intimately contacted and thermally heated in an imagewise manner by the use of a thermal source such as a thermal printing head from either the layer-free side of the sheet 1 or the sheet 4. By this, the sublimable dye in the dye transfer layer 3 is transferred to the dye receiving layer 6. After completion of the printing, the above procedure is repeated using the same dye transfer sheet while the dye receiving sheet on which the image has been transferred is replaced by a fresh sheet. In this manner, the multiple-use printing process where the dye transfer sheet is repeatedly used several to ten and several times is continued. When the combination of the sheets set forth above is used, the multiple-use printing process where a print density does not lower significantly as the number of repetitions increases becomes possible. The above process is a simple repetition mode printing process.

Figure 6:
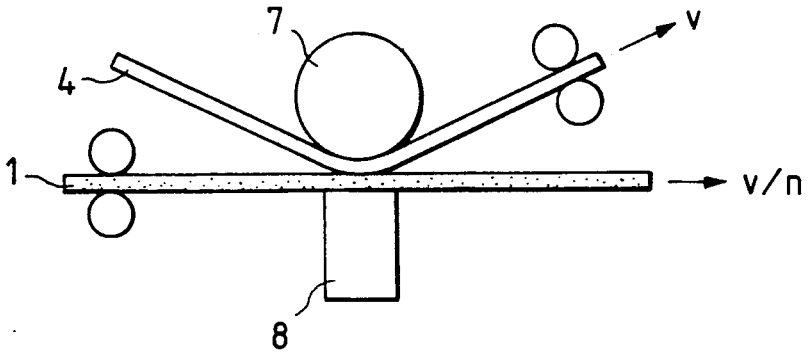
FIG. 6 is a schematic view illustrating a multiple-use mode printing using a relative running speed between a dye transfer sheet and a dye receiving sheet.

Moreover, if a lubricant is contained in or on at least one of the dye transfer layer and the dye receiving layer, a relative speed mode printing procedure becomes possible. In this procedure, a running speed of the dye transfer sheet relative to the thermal printing head is made smaller than a running speed of the dye receiving sheet relative to the thermal printing head, under which heat is applied in an imagewise pattern from the layer-free side of the dye transfer sheet or dye receiving sheet. As a result, the dye in the dye transfer layer is transferred to the dye receiving layer to form an image according to the pattern. In this mode of multiple-use printing, the lowering of print density with an increase in the ratio between the relative speeds can be suppressed to an extent which is practically acceptable. This n-times relative speed mode printing procedure is schematically shown in FIG. 6. In the figure, the dye transfer sheet 1 and the dye receiving sheet 4 are forced against a thermal printing head 8 by means of a platen 7 so that the dye transfer layer and the dye receiving layer are in face-to-face relation. The dye receiving sheet 4 is run at a speed of v relative to the thermal printing head 8 while the dye transfer sheet is run at a relative speed of v/n wherein $n \geqq 1$. The running direction of the dye transfer sheet may be either in the same as or opposite to the running direction of the dye receiving sheet.

In the above first embodiment, attention is directed to the diffusion rates of a sublimable dye in the dye transfer sheet and the dye receiving sheet. In a second embodiment of the invention wherein there are provided a dye transfer sheet having a substrate and a dye transfer layer formed on the substrate and comprised of a sublimable dye and a binder resin wherein the concentration by weight of the sublimable dye in the layer lowers from the surface side of the layer toward the side contacting the substrate and a dye receiving sheet having on a substrate a dye receiving layer capable of receiving the sublimable dye of an imagewise pattern from the dye transfer sheet, attention is paid to the consumption of a sublimable dye in the inside of the dye transfer sheet during multiple-use printing operations from the standpoint of the variation in distribution of a dye concentration in the inside of the dye transfer layer.

In an initial state prior to printing, a dye transfer layer formed by an ordinary method is uniform in composition throughout the layer, thus no gradient in concentration of the dye being present. At the first printing cycle, the dye in the vicinity of the surface of the dye transfer layer is greatly consumed owing to the great gradient in concentration between the surface of the dye transfer layer and the dye receiving layer where the concentration of the dye is zero. The dye concentration in the surface of the dye transfer layer may lower about half the concentration in the inside of the dye transfer layer. In the second and subsequent printing cycles, the sublimable dye is supplied from the inside of the dye transfer layer since the dye becomes more concentrated at the side of the dye transfer layer contacting the substrate owing to the consumption of the dye in the layer surface during the first printing cycle. The lowering speed of the concentration of the dye in the surface of the dye transfer layer becomes very small. Accordingly, when the same level of printing energy is applied to the printing system including the combination of both sheets, the print density during the multiple-use printing mode operations appreciably lowers particularly from the first printing cycle to the second cycle, but is not significantly lower in the subsequent printing cycles. In the practice of the invention, the lowering in the print density from the first to second printing operations is overcome by providing a dye transfer sheet having a dye transfer layer in which a concentration by weight of a sublimable dye is lower at a surface side of the layer than at a side contacting the substrate so that a concentration gradient is provided in the inside of the dye transfer layer. In this arrangement, the dye is supplied from the inside of the dye transfer layer from the initial printing operations. As a result, an abrupt lowering of the print density during several initial cycles of printing accompanied by an abrupt lowering of the dye concentration in the surface of the dye transfer layer does not substantially occur.

This second embodiment is more particularly described. In this embodiment, it is essential to provide a dye transfer sheet which comprises, on a substrate, a dye transfer layer which comprises at least a sublimable dye and a binder therefor in such a way that the concentration by weight of the dye is lower at the surface side of the layer than at the side contacting the substrate. For realizing a varying concentration of the sublimable dye in the dye transfer layer, the dye transfer layer may be formed by the following procedures.

(1) A plurality of sub-layers having different concentrations by weight of a sublimable dye are superposed on a substrate so that the concentration decreases from the side contacting the substrate, thereby forming a dye transfer layer composed of the plurality of the sub-layers.

(2) A dye transfer layer comprised of at least a sublimable dye and a binder therefor is formed on a substrate, after which the dye in the vicinity of the surface of the dye transfer layer is removed to form a dye transfer layer having a varying concentration of the dye.

The procedure (2) may be realized by (a) a method wherein a resin layer is intimately contacted with the dye transfer layer and heated to transfer a dye from the surface of the layer, followed by removing the resin layer, and (b) a method wherein a sublimable dye in the surface of the dye transfer layer is removed to a desired extent by dissolution in a solvent which is capable of dissolving the dye but in which the binder is sparingly soluble.

In (1), it is favorable to make the dye transfer layer which is obtained by superposing a plurality of sub-layers to make a gradient of the concentration of the dye throughout the layer. However, a dye transfer sheet having a dye transfer layer having a two-layer construction which is the easiest in fabrication is sufficient to improve the initial print density at the time of multiple-use printing operation. In this construction, a first sub-layer having a higher concentration of a sublimable dye and a second dye-permeable sub-layer having a lower concentration of the sublimable dye or even being free of any dye are superposed on a substrate in this order. For effectively suppressing an initial variation in the print density using the two-layer construction dye transfer layer, it is preferable that the concentration by weight of the dye in the dye-permeable low concentration layer is not larger than half the concentration by weight of the higher concentration layer. The thickness of the dye-permeable lower concentration layer can be controlled most effectively depending upon the ratio between the concentration by weight of the dye in the lower concentration layer and the concentration by weight of the dye in the higher concentration layer. A higher ratio makes a larger thickness. On the contrary, if the ratio is lower, the thickness should be controlled to be smaller. If the dye concentration in the dye-permeable lower concentration layer is near to or substantially zero, the thickness should preferably be in the range of not larger than 1 micrometer. In the two-layer or even multi-layer construction, the lower concentration layer has the function of protecting the higher concentration layer when the dye transfer sheet is preserved over a long term. In prior art, a high content of a sublimable dye in the dye transfer layer is one of problems to solve from the standpoint of preservation. This is solved by the two or multi-layer construction and the content of a sublimable dye in the higher concentration layer can be increased to 50 wt % or more. Accordingly, a large amount of the dye can be efficiently retained in the dye transfer sheet. In addition, since the dye is contained in high concentration, the concentration of the dye in the dye transfer layer after a plurality of printing cycles can be maintained at a high level. This enables one to effect high density printing with a small variation in the printing density if the dye transfer sheet is repeatedly used in large number.

The dye transfer sheet described above is schematically shown in FIG. 2, which includes a dye transfer sheet 1 having on a substrate 2 a dye transfer sub-layer 9 having a higher concentration of a sublimable dye and a dye-permeable lower concentration sub-layer 10 formed in this order to give a dye transfer layer 3. In this figure, the dye transfer layer is illustrated as having a two-layer construction, but may have a plurality of sub-layers as set forth before where concentrations of a sublimable dye in the plurality of sub-layers decrease from the sub-layer contacting the substrate toward the outermost sub-layer.

The two embodiments of the invention relating to thermal printing methods have been described above. As a matter of course, these methods may be used in combination, in which the dye transfer layer is so arranged as to have a dye concentration decreasing from the side contacting the substrate toward the outer surface of the layer and the dye receiving layer is made of a resin which is smaller in dye diffusion rate than the dye transfer layer. By the combination, an abrupt variation in the dye concentration in the surface of the dye transfer layer in the initial stage of multiple-use printing cycles and a lowering in the dye concentration in the surface of the dye transfer layer with an increasing number of repetitions of the printing cycle can be suitably suppressed. Accordingly, it is possible that the print density does not lower substantially from an initial cycle of the multiple-use printing till a substantial number of the printing.

In this embodiment of the combination, dyes of high weatherability and low sublimating properties may be used. In addition, a lowering in print density accompanied by an increase in the number of multiple-use printing cycles at the same level of printing energy is made small with the result that a full color hard copy of a quality almost equal to that attained by ordinary single-use printing operations can be obtained at lower running costs.

Figure 3:
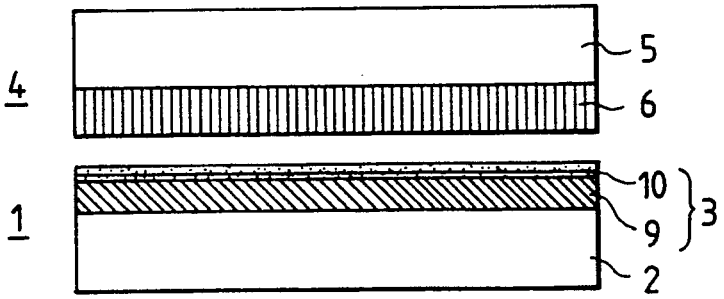
FIG. 3 is a schematic side view of a dye transfer sheet according to the invention.

The arrangement of the combination of the two embodiments of the invention is schematically shown in FIG. 3 in which the dye transfer sheet 1 having a two-layer construction is used in combination with the dye receiving sheet 4. In this arrangement, the diffusion rate of a sublimable dye in the dye transfer layer 3 is higher than that in the dye receiving layer 6.

In these embodiments, transfer of a sublimable dye by application of heat in an imagewise manner requires a heating source. The heating sourcea may be a thermal head, a current heating printing system with eelctro-resistive sheet, an induction heating printing system, a heat mode system using laser beams and the like.

Figure 2:
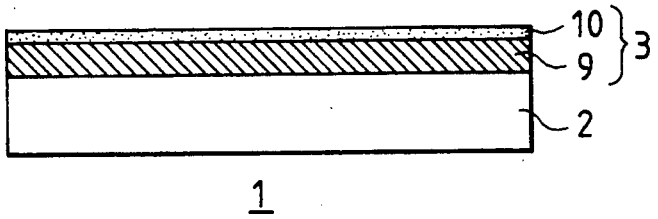
FIG. 2 is a schematic side view of a combination of a dye transfer sheet having a dye transfer layer whose concentration of a sublimable dye is varying along the thickness thereof and a dye receiving sheet for illustrating a thermal printing method according to another embodiment of the invention.

In the practice of the invention, there is further provided a thermal printing system of the multiple-use mode wherein a dye transfer sheet is repeatedly used in combination with fresh dye receiving sheets. The dye transfer sheet has a substrate and a dye transfer layer formed on the substrate wherein the concentration by weight of a sublimable dye in the layer lowers from the surface side of the layer toward the side contacting the substrate. This type of dye transfer sheet is used in the method of the second embodiment. Accordingly, the dye transfer sheet as illustrated in FIG. 2 is usable in this system and also the dye transfer sheet having a plurality of dye transfer sub-layers in which a concentration of the dye in the respective layers decreases from the sub-layer contacting the substrate toward the outer sub-layer of the dye transfer layer is usable. The dye transfer sheet of this type is described and is particularly suitable for use in the method of th second embodiment and in the system of this embodiment.

The multiple-use mode used herein means not only a simple repetition procedure, but also a n-times relative speed mode procedure.

As described before, when the dye transfer sheet as illustrated in FIG. 2 is used to carry out the multiple mode thermal printing while the dye transfer layer of the dye transfer sheet and the dye receiving layer of the dye receiving sheet are in intimate contact with each other, the print density of the resultant hard copies at an initial stage of the printing does not lower significantly.

For the n-times relative mode mode printing procedure, a lubricant is added to, or formed as a layer on at least one of the dye transfer layer and the dye receiving layer. In this printing procedure, a relative speed of the dye transfer sheet to a thermal printing head is made smaller than a relative speed of the dye receiving sheet to the thermal printing head. In this condition, the dye in the dye transfer layer is transferred in an imagewise pattern by selectively heating either the dye transfer sheet or the dye receiving sheet from the layer-free side, thereby forming an image according to the pattern. In the multiple-use printing of the relative speed system, a printing density particularly at initial printing cycles does not lower significantly.

Fabrication of the dye transfer sheet used in the system of the invention and also in the method according to the second embodiment of the invention is described, in which at least one dye-permeable sub-layer having a lower concentration of a dye or free of the dye is effectively formed on a sub-layer having a higher concentration of the dye.

If coating solutions in solvent having different concentrations of a dye are applied as superposed so that a layer of a higher concentration of the dye is first formed on a substrate, the higher concentration layer is usually dissolved upon application of a subsequent coating solution. Because of the high concentration of the dye, the concentration of the dye in the subsequent layer will readily be varied at a level higher than as intended. This type of dye transfer sheet does not yield good multiple-use printing characteristics.

To avoid this, a dye sub-layer having a higher concentration of a sublimable dye is first formed on a substrate, on which a dye-permeable lower concentration sub-layer is formed using an aqueous coating comprising the dye and a water-soluble or dispersable resin. When the aqueous coating composition is used, the first sub-layer is hardly dissolved by means of the aqueous coating. Preferably, the first sub-layer is formed using a non-aqueous coating composition using an organic solvent. Once the second sub-layer has been formed and dried, an aqueous coating composition having a lower concentration of the dye may be further formed as another sub-layer on the second sub-layer, if desired. In this manner, a plurality of sub-layers may be readily formed to obtain a dye transfer layer with a multiple layer construction.

The water-soluble or dispersable resins are not critical. In view of dye permeability, preservation and solvent resistance which is necessary if a lubricant layer is formed on the top of the dye transfer layer, partially saponified polyvinyl alcohol, water-soluble saturated polyester resins, water-dispersable polyurethane resins and the like are preferred.

When lubricity is imparted to the dye transfer layer, such a dye transfer sheet is conveniently used in an n-times relative speed mode system which ensures a greater number of multiple-use printing cycles than the simple repetition system.

For the impartment of lubricity to the dye transfer layer according to the invention, there may be broadly used the following two techniques.

(1) A lubricant is contained in or on the surface of the dye transfer layer.

(2) A surface molecular layer having high lubricity is formed on the surface of the dye transfer layer by chemical reaction.

The technique (1) may be realized by two methods. When the dye transfer layer is made of a single layer construction as used in the method of the first embodiment, a coating solution for the dye transfer layer containing a lubricant is applied onto a substrate, dried or thermally treated under conditions which cause the lubricant to be concentrated more highly in the vicinity of the surface. More particularly, the applied layer is dried or thermally treated after allowing to stand for a certain time in the order of several seconds. Alternatively, a lubricant layer comprising a lubricant may be formed on the dye transfer layer.

If the dye transfer layer is made of a two or multilayer construction as used in the method of the second embodiment and the system, a lubricant may be contained in a dye-permeable lower concentration sublayer of the dye transfer layer. Alternatively, a lubricating layer containing at least a lubricant may be formed on the lower concentration sub-layer.

Figure 4:
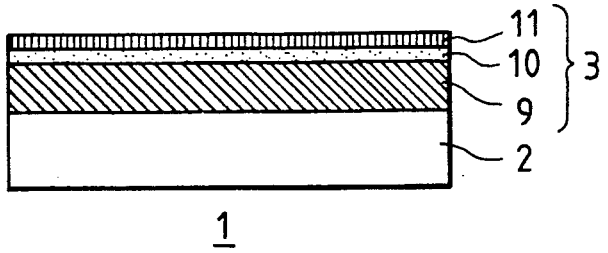
FIGS. 4 and 5 are, respectively, schematic side views of dye transfer sheets according to the invention.

FIG. 4 shows formation of a lubricant layer 11 on the dye transfer layer 3 which is formed on the substrate 2. If the dye transfer layer 3 is made of a two layer construction which includes a sub-layer 9 having a higher concentration of a sublimable dye and provided in contact with the substrate 2 and a sub-layer 10 having a lower concentration of the sublimable dye and formed on the sub-layer 9.

The lubricants used for this purpose are described in detail hereinafter. It should be noted that the lubricant is not critical but is selected from those lubricants which do not adversely influence storage stability of the dye transfer sheet and transfer characteristics.

As will be described in detail, if a lubricant is made of a reaction product of at least two reactive silicone oils each having a plurality of reactive functional groups in one molecule, good results are obtained particularly fro the relative speed mode printing because the reaction product is a polymer. This type of lubricant does not involve any problems that a lubricant diffuses into the dye transfer layer by application of heat for printing and thus lubricity is not shown and that a lubricant is transferred to a dye receiving layer, giving an adverse influence on stability of a printed image.

The technique (2) is realized by a method wherein the dye transfer layer should comprise a resin having reactive functional groups and these reactive functional groups are reacted with a linear hydrocarbon derivative having not less than 12 carbon atoms and also having functional groups reactive with the reactive functional groups of the resin to form a layer of the hydrocarbon groups on the surface of the dye transfer layer. The type of reaction between the resin and the linear hydrocarbon derivative is not critical. Preferably, the reaction should proceed at normal temperatures in the absence of a catalyst. Typical reactions are those reactions between (1) hydroxyl groups and acid chlorides, (2) hydroxyl groups and silane coupling agents, and (3) glycidyl groups and amines.

Figure 5:
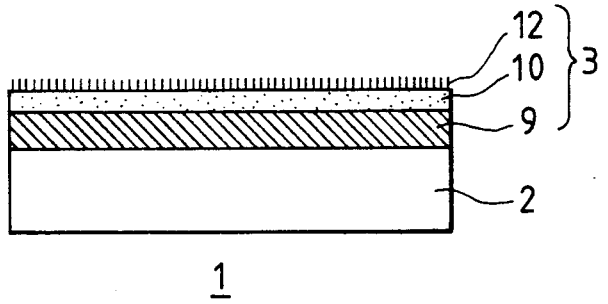

FIG. 5 schematically shows a dye transfer sheet using a linear hydrocarbon derivative. In the figure, there is shown the dye transfer sheet 1 which has the substrate 2 and the dye transfer layer 3 formed on the substrate 2. On the surface of the layer 3 is a layer 12 of linear hydrocarbon groups reacted with the resin in the dye transfer layer 3. As a matter of course, the dye transfer layer 3 may be made of a double layer construction as shown in FIG. 5 which includes the sub-layer 9 of a higher concentration of a sublimable dye and the sub-layer 10 of a lower concentration of the sublimable dye. Alternatively, a number of sub-layers (not shown) may be included as the layer 3 wherein the concentration of the sublimable dye decreases from the side contacting the substrate 2 toward the outer surface.

In general, lubricity on the surface of a plastic resin layer produced by application of an external lubricant is considered as follows: a lubricant applied onto the surface or migrated from the inside of the layer to the surface forms a surface molecular layer, which causes the free energy on the surface of the plastic resin to lower thereby imparting lubricity to the layer. Moreover, such a surface molecular layer is considered to give higher lubricity at a higher degree of crystallinity. However, where the dye transfer layer is heated at high temperatures as in thermal dye transfer printing, crystal sites of the surface molecular layer is considered to be readily broken. In addition, when a lubricant is contained in the dye transfer layer, the dye is more likely to migrate in the inside of the matrix of the dye transfer layer. If the lubricant is localized, the dye passes through the localized portion and may recrystallize. In accordance with the invention, linear hydrocarbon groups having 12 or more carbon atoms are introduced into the binder resin of the dye transfer layer by chemical reaction whereby there is obtained the dye transfer layer whose surface has high lubricity without influencing the migration of the dye in the inside of the layer and with the breakage of the surface molecular layer hardly occurring. Thus, stable relative speed mode printing becomes possible.

In the foregoing, lubricity is imparted to the dye transfer layer, and similar results are obtained when lubricity is imparted to the dye receiving layer in the same manner as described above.

In the practice of the invention, transfer of a sublimable dye in an imagewise manner from the dye transfer sheet to the dye receiving sheet may be effected using heating sources such as thermal printing heads, heat mode laser systems, current energizing systems and the like. This is not specific and is not further described herein.

The materials for the dye transfer sheet and dye receiving sheet for used in the methods of the first and second embodiments and the thermal printing system are described.

The dye transfer sheet comprises a substrate and a dye transfer sheet. The type of material for the substrate depends upon the type of heating source. If thermal printing heads are used for the heating, there are used polyesters such as polyethylene terephthalate, polyethylene naphthalate, polycarbonates and the like, polyamides such as various nylons, cellulose derivatives such as acetyl cellulose, regenerated cellulose and the like, polyimides such as polyimides, polyamide-imides and polyether imides, and the like. These materials are used in the form of a film or sheet having a thickness of from 2 to 20 micrometers although not critical. If the substrate is directly contacted with a thermal printing head, a heat-resistant layer or lubricant layer may be formed as is known in the art.

For printing by electric or induction heating, conductive materials such as carbon black are added to the above materials to allow electric conductivity.

The dye transfer layer is made fundamentally of a sublimable dye and a binder therefor. The sublimable dyes usable in the practice of the invention may be any sublimable dyes ordinarily employed for this purpose. Examples such dyes include disperse dyes, basic dyes and dye formers of basic dyes. Typical and specific examples are set forth in the examples appearing hereinafter.

The binders used in combination with the sublimable dye are not critical and include, for example, polyester resins, butyral resins, polyamide resins, polycarbonate resins, urethane resins, chlorinated polyethylene, chlorinated polypropylene, (meth)acrylic resins, polystyrene resins, AS resins, polysulfone resins, polyphenylene oxide, cellulose derivatives. These may be used singly or in combination, depending upon required characteristics of the dye transfer sheet.

If the dye transfer layer is made of a double layer or multiple layer construction, a sub-layer of a higher concentration of dye formed in contact with the substrate may be made of a sublimable dye alone. As a matter of course, a binder as indicated above may be used in combination. In this case, the sublimable dye is generally contained in an amount of not less than 50 wt % of the total solid composition. Aside from the binder, other additives such as lubricants, dispersants for the dye and the like ordinarily used for this purpose may be added to the composition for the higher concentration sub-layer. In this connection, care should be taken that if silicone compounds or waxes are added, the surface free energy on the higher concentration sub-layer becomes small, so that an aqueous paint having a relatively high surface free energy is difficult to apply.

For formation of the dye transfer layer of a single layer construction or the higher concentration sub-layer, sublimable dyes and/or binders therefor are dissolved in solvent to prepare an ink composition. This composition is applied onto the substrate and dried to form a dye transfer layer. The solvents include, for example, alcohols such as methanol, ethanol, propanol, butanol and the like, cellosolves such as methyl cellosolve, ethyl cellosolve and the like, aromatic compounds such as benzene, toluene, xylene and the like, esters such as butyl acetate, ketones such as acetone, 2-butanone, cyclohexanone and the like, nitrogen-containing compounds such as N,N-dimethylformamide, and halogenated hydrocarbons such as dichloromethane, chlorobenzene, chloroform and the like.

The ink composition may be formed on a substrate by any known coating methods using, for example, reverse roll coaters, gravure coaters, rod coaters, air doctor coaters and the like.

For multiple-use printing, the thickness of the dye transfer layer of a single-layer construction or the higher concentration sub-layer may depend upon the concentration of the dye in the layer or sub-layer, the intended number of printing repetitions, the relative speed ratio in case where the dye transfer sheet is applied to a relative speed system and the amount of dye on a dye receiving sheet required to give an intended printing density. The minimum dry weight of the coating layer according to the following equation should preferably be ensured.

Minimum dry coating weight ($g/m^2$) = (intended number of printing repetitions) × (required amount of dye, $g/m^2$)/(concentration by weight of dye)

The single layer as used in the method of the first emebodiment or the higher concentration sub-layer has been described above. If the dye transfer layer is of a double layer construction, a dye-permeable lower concentration sub-layer is formed on the higher concentration sub-layer.

This sub-layer is made of the sublimable dye as used in the first sub-layer and a resin which is soluble or dispersable in water. Such resins may include polyvinyl alcohol, poly(meth)acrylic acid esters and metal salts thereof, polyacrylamides, aqueous urethane resins, aqueous acrylic resins, aqueous polyester resins and the like. The dyes are permeable to these resins when formed as a film. Among the resins mentioned above, polyvinyl alcohol having a high degree of saponification and the homopolymer of acrylic acid have a small diffusion rate of dye. If these resins are used as a film with a large thickness, satisfactory printing sensitivity may not be obtained. In addition, the variation in thickness gives a great influence on the printing sensitivity and multiple-use printing characteristics. Accordingly, these resins may not necessarily be used satisfactorily. In this sense, preferable water-soluble and dispersable resins having an appropriate rate of diffusion of dye include polyvinyl alcohol having a degree of saponification of from 30 to 90%, water-soluble or dispersable polyester resins, water-soluble or dispersion urethane resins, and water-soluble or dispersable acrylic resins.

Moreover, when the higher concentration sub-layer, the lower concentration sub-layer and a lubricant layer are superposed on a substrate in this order as shown in FIG. 4, the dye-permeable lower concentration sub-layer may be attacked by a coating solution for the lubricant layer. This causes the concentration of dye in the surface of the dye transfer layer to be higher than as desired, resulting in poor multiple-use printing characteristics. To avoid this, the resin used to make the lower concentration sub-layer should be resistant to organic solvent. Such resins which are soluble or dispersable in water include polyvinyl alcohol having a degree of saponification of from 70 to 90% and water-soluble or dispersable urethane resins. This is true of the case where a plurality of sub-layers wherein a dye concentration is decreased toward an uppermost layer are formed to give a dye transfer layer having a plurality of sub-layers. Moreover, when a lubricant is contained in the dye-permeable lower concentration sub-layer, the lubricant used should be soluble or emulsifiable in an aqueous coating composition for the sub-layer. These lubricants may be those indicated with respect to the lubricant layer described hereinafter.

For the formation of the dye-permeable lower concentration sub-layer, alcohols, ketones, cellosolves and the like which are miscible with water may be added to water in order to prepare an ink composition. If a lubricant is added, suitable emulsifiers for the lubricant may be added. In order to lower the surface tension of the ink composition, surface active agents may be added.

The thickness of the dye permeable lower concentration sub-layer may vary depending upon the dye diffusion rate of the water-soluble or dispersable resin used, the energy necessary for intended printing and the number of multiple-use printing cycles or the relative speed ratio, n, in the relative speed mode printing system. If the number of the printing cycles or the value of n in the relative speed e printing system is in the order of several tens, the thickness is conveniently in the range of from 0.1 to 1 micrometers.

The dye receiving sheet is made of a substrate and a dye receiving layer and may be any known sheets of this type. Transparent substrates may be various films such as of polyesters, and white substrates may be synthetic paper sheets made of polyesters or polypropylene, coated paper, and ordinary paper.

The dye-receiving layer formed on the substrate is made of various resins such as polyesters, polyamides, acrylic resins, acetate resins, cellulose derivatives, starch, polyvinyl alcohol and the like. Moreover, there are also used cured products of acrylic resins including polyacrylic acid and polyacrylates, polyesters, polyurethane resins, polyacrylates, polyamides, acetate resins and the like which are capable of being cured by application of heat, light, UV, electron beams and the like. These may be used singly or in combination. The dye receiving layer is fundamentally in a thickness of 1 to 10 micrometers.

In the method of the first embodiment, the diffusion rate of dye in the dye receiving layer should be smaller than that in the dye transfer layer. For this purpose, a cured resin should be contained in an amount of not less than 25 wt % of the total composition of the layer. The cured resin is selected from the above-noted resins. As described before, water-soluble resins are also effective to reduce the diffusion rate. Examples of such water-soluble resins are those indicated before, including polyvinyl alcohol having a degree of saponification of from 70 to 90% and water-soluble urethane resins. These water-soluble resins may be used by mixing with water-dispersable resins in an amount of not less than 25 wt %. By this, similar results as with the case using the cured resin can be obtained.

Lubricants which are used in the dye transfer layer, dye-permeable lower concentration sub-layer, lubricant layer and/or dye receiving layer are described. The lubricants may be either liquid or solid and include, for example, petroleum lubricating oils such as liquid paraffin, synthetic lubricating oils such as halogenated hydrocarbons, diester oils, silicone oils, fluorine-containing silicone oils and the like, various modified silicone oils such as epoxy, amino, alkyl and polyester-modified silicone oils, silicone lubricating materials such as copolymers of organic compounds such as polyoxyalkylene glycol and silicones, various fluorine-containing surface active agents such as fluoroalkyl compounds, fluorine-containing lubricating materials such as oligomers of trifluorochloroethylene, waxes such as paraffin wax and polyethylene wax, higher fatty alcohols, higher alcohols, higher fatty acid amides, higher fatty acid esters, higher fatty acid salts and the like. Although some liquid lubricants are indicated above, such liquid lubricants include, for example, dimethylpolysiloxane, methylphenylpolysiloxane, methylhydrogenpolysiloxane, fluorine-containing silicone oils, other various modified silicone oils such as epoxy, alkyl, amino, carboxyl, alcohol, polyether, alkyl/aralkyl/polyether and epoxy/polyether-modified silicone oils, silicone lubricating materials such as copolymers of organic compounds such as polyoxyalkylene glycol and silicones, organic metal salts, various fluorine-containing surface active agents, fluorine-containing lubricating materials such as oligomers of trifluorochloroethylene, synthetic oils such as alkylbenzenes, polybutene, alkylnaphthalenes, alkyldiphenylethanes, phosphoric esters, polyalkylene glycol oils and the like, saturated hydrocarbons, animal and plant oils, mineral oils and the like. These lubricants may be used singly or in combination.

When a lubricant layer made of a liquid lubricant is formed on the dye transfer layer, the liquid lubricant may often be transferred to the dye receiving layer in a state where the dye is dissolved in the liquid lubricant even when heat is not applied to the dye transfer or receiving sheet. Accordingly, if a lubricant layer is formed on the dye transfer sheet, solid lubricants are preferably used including those materials having a melting point of not lower than 60° C., e.g. waxes, fatty acid amides, fatty acids, reaction products of reactive silicone oils and the like which satisfy the requirement for the melting point. More preferably, paraffin wax and microcrystalline wax are used in view of the solubility in various solvents. Further, reaction products of at least two reactive silicone oils each having a plurality of reactive functional groups in one molecule are more preferably used as a lubricant layer as shown in FIG. 4. Alternatively, these reaction products may be used by incorporation into the dye transfer layer. The combinations of the at least two reactive silicone oils are those of epoxy-modified silicone oils and carboxyl or amino-modified silicone oils, and carboxyl-modified silicone oils and amino-modified silicone oils. These reactions conveniently proceed in the absence of any catalyst.

Where the lubricant layer as shown in FIG. 4 is formed, binders may be used in combination. The binders may be not only those resins set forth with respect to the higher concentration sub-layer, but also water-soluble and dispersable resins indicated before. In this connection, however, the resin used should preferably have a high diffusion rate of dye in order not to lower printing characteristics of the dye transfer sheet.

To avoid this, the use of the reaction products of at least two reactive silicone oils described above is preferred.

The embodiment shown in FIG. 5 wherein linear hydrocarbon groups are chemically combined with the dye transfer layer and act as a lubricant is described with respect to the materials.

In this embodiment, the dye transfer layer 3 should contain a resin binder having reactive functional groups. The functional groups may be those derived from acid chloride, silane and amines but if these monomers are left unreacted, problems arise in that these monomers will give adverse influences on the printing characteristics. Accordingly, the resin binder should preferably have hydroxyl group and/or glycidyl groups as the reaction functional group. Examples of the resin include polymers having vinyl alcohol units or glycidyl acrylate or methacrylate units, and polyester resins having a hydroxyl group at terminals thereof. The reactive functional groups should preferably be present in an amount of 10 mole % per molecule of the polymer. If the number of the functional groups is too small, the density of linear hydrocarbon groups having 12 or more carbon atoms to be introduced becomes small, with a reduced effect of the lubricity. For facilitating the reaction with linear hydrocarbon derivatives, with the polyvinyl alcohol or glycidyl (meth)acrylate polymer, 30 mole % to 100 mole % of alcohol or glycidyl (meth)acrylate monomers based a starting monomer composition of a final polymer is preferably mixed for permitting the monomers to be present in the dye transfer layer. For this purpose, the monomer is added to and dissolved in an ink composition for the formation of th dye transfer layer along with other resin binder. This ink composition is coated onto a substrate by which the monomer-containing layer is obtained.

The linear hydrocarbon derivatives having functional groups reactive with the reactive functional groups of the resin and having not less than 12 carbon atoms are those compounds having both a linear hydrocarbon group having not less than 12 carbon atoms and an acid chloride, di or trichlorosilane, alkoxysilane or amino group. Specific and preferable examples include lauric acid chloride, stearic acid chloride, erucic acid chloride, oleic acid chloride, lauryl trichlorosilane, stearyl trichlorosilane, laurylamine, stearylamine and oleylamine.

These derivatives may be introduced into the surface of the dye transfer layer having a reactive resin in the following manner. After formation of a dye transfer layer having a resin having reactive functional groups, a solution of the linear hydrocarbon derivative in a solvent is applied onto the layer surface by a spraying method, a gravure coating method or the like. The solvent should preferably be incapable of dissolving the dye transfer layer and includes, for example, hexane, octane and the like hydrocarbons. The concentration of the derivative is not critical and is generally in the range of from 0.1 to 10 wt % of the solution. Alternatively, the derivative may be formed as a monolayer by the Langmuir-Blodgett method. The linear hydrocarbon derivative applied onto the layer surface by these methods is allowed to stand for a certain time, during which it reacts with the reactive functional groups present in the layer surface and fixes in situ. If necessary, unreacted derivative and side products remaining on the surface may be removed by washing the surface with a solvent incapable of dissolving the dye transfer layer.

The present invention is more particularly described by way of example. In the examples, a 6 micrometer thick aromatic polyamide film having a heat-resistant lubricant layer was commonly used as a substrate of a dye transfer sheet. A substrate for a dye receiving sheet was a white synthetic paper made of polyethylene terephthalate. The dye used was of the following structural formula

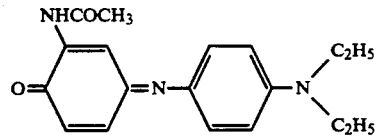

For printing, a thermal printing head was used with the following fundamental printing conditions.

Printing cycle—16.7 ms/l

Printing pulse width—4.0 ms (max)

Resolution—6 l/mm

Printing energy—about 6 J/cm$^2$ (variable)

In order to check diffusion rates of the dye in dye transfer and dye receiving sheets, several combinations of both sheets were fabricated and subjected to a simple repetition procedure to determine multiple-use printing characteristics.

EXAMPLE 1

A dye transfer sheet was made by applying onto the substrate an ink composition of 4 g of the dye and 4 g of butyral resin (S-lek BX-1, Sekisui Chem. Co., Ltd.) dissolved in a mixed solvent of 42 g of toluene and 18 g of methyl ethyl ketone by means of a wire bar in such a way that the dye was coated in an amount of 1.0 g/m$^2$, and dried.

Separately, an aqueous dispersion of 66.6 g of a saturated linear polyester resin dispersion (Vyronal MD-1200, available from Toyobo Co., Ltd.), 31.6 g of a silane polymer/colloidal silica composite emulsion (Movinyl 8020, made by Hoechst Syn. Co., Ltd.) and 1.8 g of a surface active agent (PEG-6000S, available from Sanyo Chem. Ind. Co., Ltd.) was applied onto the substrate by means of a wire bar in a dry thickness of about 5 micrometers and sufficiently dried to obtain a dye receiving sheet.

EXAMPLE 2

An ink composition comprised of 4 g of the same dye as used in Example 1, 4 g of AS resin (Denkastyrol AS-SU, available from Denki Kagaku K.K.) dissolved in 60 g of monochlorobenzene was applied onto the substrate by means of a wire bar in an amount of 1.0 g/m$^2$ of the dye and dried to obtain a dye transfer sheet.

A dye receiving sheet used in combination with the dye transfer sheet was the same as obtained in Example 1.

COMPARATIVE EXAMPLE 1

An ink composition comprised of 4 g of the same dye as used in Example 1 and 4 g of a linear saturated polyester resin (Vyron RV290, available from Toyobo Co., Ltd.) dissolved in 60 g of monochlorobenzene was applied onto the substrate by means of a wire bar in an amount of 1.0 g/m$^2$ of the dye and dried to obtain a dye transfer sheet.

The dye receiving sheet used was the same as obtained in Example 1.

COMPARATIVE EXAMPLE 2

An ink composition comprised of 4 g of the same dye as used in Example 1 and 4 g of polysulfone (P-1700, available from Nissan Chem. Co., Ltd.) dissolved in 60 g of monochorobenzene was applied onto the substrate by means of a wire bar in an amount of 1.0 g/m$^2$ of the dye and dried to obtain a dye transfer sheet.

The dye receiving sheet used was the same as obtained in Example 1.

COMPARATIVE EXAMPLE 3

The dye transfer sheet used was the same as obtained in Comparative Example 1.

A dye receiving sheet was made in the following manner. A solution of a UV curable polyester urethane acrylate resin (DEFENSA MCF-3M-2, available from Dainippon Ink & Chemicals Inc.) 5 wt % of a UV curing initiator based on the UV curable resin (Irgacure 184, available from Nippon Ciba Geigy) and a saturated polyester resin (Vyron 200, available from Toyobo Co., Ltd.) dissolved in a mixed solvent of methyl ethyl ketone and ethyl acetate at a mixing rate of 1:3 was prepared in which the content by weight of the curable resin based on the total resin solids was 15 wt %. This solution was coated on the substrate by means of a wire bar in a dry thickness of about 5 micrometers and dried at 60° C. for 5 minutes, followed by irradiation with a 1 KW mercury lamp for 2 minutes to cure the curable resin, thereby forming a dye transfer sheet.

EXAMPLE 3

The dye transfer sheet used was the same as obtained in Comparative Example 1.

The dye receiving sheet used was the same as obtained in Comparative Example 3 except that the content of the UV curable resin based on the total resin solids was 25 wt %.

EXAMPLE 4

The dye transfer sheet used was the same as obtained in Comparative Example 1.

The dye receiving sheet used was the same as obtained in Comparative Example 3 except that the content of the UV curable resin based on the total resin solids was 100 wt %.

COMPARATIVE EXAMPLE 4

The dye transfer sheet used was the same as obtained in Comparative Example 1.

A dye receiving sheet was obtained by applying onto the substrate a mixture of an aqueous solution of a polyvinyl alcohol resin (Poval 420, available from Kuraray Co., Ltd.) and an aqueous dispersion of a saturated polyester resin (MD-1200, available from Toyobo Co., Ltd.) so that the solid content of the polyvinyl alcohol resin was 15 wt % of the total resin solids in a dry thickness of about 5 micrometers and sufficiently dried to form a dye receiving layer.

EXAMPLE 5

The dye transfer sheet used was the same as obtained in Comparative Example 1.

The dye receiving sheet used was the same as obtained in Comparative Example 4 except that the solid content of the polyvinyl alcohol resin was 25 wt % based on the total resin solids in the dye receiving layer.

EXAMPLE 6

The dye transfer sheet used was the same as obtained in Comparative Example 1.

The dye receiving sheet used was the same as obtained in Comparative Example 4 except that the solid content of the polyvinyl alcohol resin was 100 wt % based on the total resin solids in the dye receiving layer.

The combinations of the dye transfer sheets and the dye receiving sheets obtained in Examples 1 to 6 and Comparative Examples 1 to 4 were subjected to the simple repetition multiple-use printing procedure at the same level of printing energy to determine a variation in printing density as expressed by printing density at the third printing cycle/printing density at the first printing cycle (%). The printing energy was so controlled that the printing density at the first cycle was 2.0. The results are shown in Table 1 below.

In order to check a diffusion rate of the binder resins used, the dye transfer sheet obtained in Example 1 was used in combination with the dye receiving sheets using these binder resins as the dye receiving layer to determine printing densities on the respective receiving layers. The following results are obtained in the order of high printing density or fast diffusion rate.

Butyral resin > AS resin > dye receiving layer of Example 1 made primarily of polyester > polyester resin (used in the dye receiving layers such as of Example 1 and Comparative Example 3) > polyester resin (used in the dye transfer layer such as of Comparative Example 1) > polysulfone resin > UV cured resin (used in the dye receiving layer such as of Comparative Example 3) > polyvinyl alcohol (used in the dye receiving layer such as of Comparative Example 4).

TABLE 1

| | Binder of Dye Transfer Layer | Binder of Dye Receiving Layer | Variation in Printing Density (%) |
|---|---|---|---|
| Example 1 | butyral resin | polyester resin as major component | 70 |
| Example 2 | AS resin | polyester resin as major component | 65 |
| Comp. Ex. 1 | polyester resin | polyester resin as major component | 50 x |
| Comp. Ex. 2 | polysulfone resin | polyester resin as major component | 45 x |
| Comp. Ex. 3 | polyester resin | UV cured resin 15 wt % | 50 x |
| Example 3 | " | UV cured resin 25 wt % | 65 |
| Example 4 | " | UV cured resin 100 wt % | 70 |
| Comp. Ex. 4 | " | water-soluble resin 15 wt % | 50 x |
| Example 5 | " | water-soluble resin 25 wt % | 65 |
| Example 6 | " | water-soluble resin 100 wt % | 75 |

The variation in the printing density (%) = (printing density at the third printing cycle)/(printing density at the first printing cycle)

In the following example, the effect of the diffusion rates in dye transfer layers and dye receiving layers using different binder resins was checked using a relative speed multiple-use printing system.

EXAMPLE 7

The dye transfer sheet used was the same as obtained in Example 1.

The dye receiving sheet used in combination was the same as obtained in Example 4 except that a silicone surface active agent (KF3935, available from Shin-etsu Chem. Co., Ltd.) was added in an amount of 0.5 wt % based on the total solid content in the dye receiving layer.

Both sheets were contacted so that the dye transfer layer and the dye receiving layer were facing each other. The relative speed multiple-use printing procedure was carried out in such a way that the dye transfer sheet was run at a speed of 1/5 (i.e. n=5) of the dye receiving sheet relative to a thermal printing head. As a result, it was found the running was stable and the printing density was 70% of an ordinary single-use printing procedure wherein n=1.

In the following examples and comparative examples, the effect of a distribution in concentration of the dye in the dye transfer layer was checked.

COMPARATIVE EXAMPLE 5

The dye transfer sheet obtained in Comparative Example 1 was provided for the checking test.

EXAMPLE 8

The dye transfer sheet of Comparative Example 1 was provided, and a solution of a polyester resin used as a binder resin of the dye transfer layer of this sheet was quickly applied onto the dye transfer layer in a dry thickness of 0.2 micrometers and dried to form a dye-permeable dye-free sub-layer on the dye transfer layer, thereby providing a dye transfer sheet having a double layer construction.

EXAMPLE 9

The dye transfer sheet used was the same as obtained in Comparative Example 1 except that this sheet was subjected to a printing procedure at a printing energy level of 6 J/cm$^2$ to remove the dye on or in the surface of the dye transfer layer by transfer to a dye receiving layer of the dye receiving sheet of Example 1. In this manner, the dye concentration in the surface of the dye transfer layer was reduced.

EXAMPLE 10

The dye transfer used was the same as obtained in Comparative Example 1 except that the dye transfer layer was washed with methanol on the surface thereof to remove the dye from the layer surface.

EXAMPLE 11

The general procedure of Example 8 was repeated except that the dye-permeable dye-free sub-layer was replaced by a sub-layer which was formed by applying onto the dye transfer layer of the dye transfer sheet an ink composition comprising a polyester resin as used in Example 8 and the dye defined before at a ratio by weight of the dye and the resin of $\frac{1}{3}$ in a dry thickness of 0.2 micrometers and drying to obtain a dye transfer sheet with a double layer construction. The dye concentration in the upper sub-layer is $\frac{1}{2}$ of the lower layer.

The above procedure was repeated except that the ratio by weight of the dye/the resin was $\frac{1}{2}$ which corresponded to $\frac{2}{3}$ of the dye concentration in the lower layer.

The dye transfer sheets obtained in Examples 8 to 11 and Comparative Example 5 were subjected to a simple repetition procedure using the dye receiving sheet as used in Example to determine an initial variation in concentration at the same level of printing energy. The initial variation (%)=printing density at the second cycle/printing density at the first cycle. The printing energy was so controlled that the printing density at the first printing cycle was about 2.0. The results are shown in Table 2.

TABLE 2

| | Layer Construction | Variation in Printing Density |
|---|---|---|
| Comp. Ex. 5 | single layer | 65 x |
| Example 8 | double layer construction (dye conc. in the upper layer = 0) | 85 |
| Example 9 | single layer but surface dye removed by transfer | 90 |
| Example 10 | single layer but surface dye removed by dissolution | 85 |
| Example 11 | double layer construction (dye conc. in the upper layer: $\frac{1}{2}$ in the lower layer) | 80 |
| | double layer construction (dye conc. in the upper layer: $\frac{2}{3}$ in the lower layer) | 75 |

As will be apparent from the above, it is preferred that the dye concentration in the upper sub-layer is not larger than $\frac{1}{2}$ of that in the lower sub-layer.

Then, the effect of the dye concentration in the lower sub-layer of the dye transfer layer having a double layer construction was checked.

EXAMPLE 12

A dye transfer sheet was made by applying onto the dye transfer layer of the dye transfer sheet of Comparative Example 1 a solution of polyester as used in the dye transfer layer in a dry thickness of 0.5 micrometers and dried to form a dye-permeable upper sub-layer on the dye transfer layer.

EXAMPLE 13

The general procedure of Example 1 for the fabrication of the dye transfer sheet was repeated except that an ink composition comprised of 5 g of the dye and 3 g of the polyester resin was applied onto the substrate in an amount of the dye of 1.0 g/m, followed by forming a dye-permeable upper sub-layer having a lower concentration of the dye in the same manner as in Example 10.

EXAMPLE 14

The general procedure of Example 1 for the fabrication of the dye transfer sheet was repeated except that an ink composition comprised of 6 g of the dye and 2 g of the polyester resin was applied onto the substrate in an amount of the dye of 1.0 g/m$^2$, followed by forming a dye-permeable upper sub-layer having a lower concentration of the dye in the same manner as in Example 10.

The dye transfer sheets obtained in Examples 12 to 14 and the dye receiving sheet obtained in Example 1 were combined and subjected to a simple repetition multiple-use printing procedure to determine a variation of printing density at the same level of printing energy. The variation was determined as a ratio by % of printing density at the fifth printing cycle/printing density at the first printing cycle. The printing energy was so controlled that the printing density at the first printing cycle was about 2.0. The results are shown in Table 3.

TABLE 3

| | Content by wt % of Dye in Dye Transfer Layer | Variation in Printing Density |
|---|---|---|
| Example 12 | 50.0 | 60 |
| Example 13 | 62.5 | 75 |
| Example 14 | 75.0 | 80 |

Variation in the density = (printing density at the fifth cycle)/(printing density at the first cycle)

The method for the formation of a dye-permeable lower concentration sub-layer of the dye transfer sheet is particularly described.

EXAMPLE 15

A dye transfer sheet was made by applying onto the dye transfer layer of the dye transfer sheet of Comparative Example 1 a coating composition comprised of an aqueous dispersion of 10% of a water-soluble polyester resin (WR-900, available from the Nippon Synthetic Chem. Ind. Co., Ltd.) and 1% of a fluorine-containing surface active agent (Megafax F-812, available from Dainippon Ink & Chemicals Inc.) in a dry thickness of 0.2 micrometers and dried to form a dye-permeable upper sub-layer free of dye.

In Example 15, the upper layer could be formed without involving any dissolution of the dye in the lower layer at the time of the application of the coating composition. The dye transfer sheet of Example 15 was used in combination with the dye receiving sheet obtained in Example 15 and subjected to a simple repetition multiple-use printing procedure at the same level of printing energy to determine a variation in the printing density=printing density at the second cycle/printing density at the first cycle (%). The variation was 75%.

EXAMPLE 16

In this example, the effect of the distribution of concentration of dye in a dye transfer layer in a relative speed multiple-use printing procedure was determined.

A dye transfer sheet was was made in the same manner as in Example 12 except that 10 wt % of a lubricant made of paraffin wax having a melting point of 50° C. and oleic acid amide at a mixing ratio by weight of 1:1 was added to each of the lower sub-layer having a higher concentration of the dye and the upper sub-layer i.e. dye-permeable lower concentration sub-layer. The dye receiving sheet used was the same as obtained in Example 4.

Both sheets were used to intimately contact the dye transfer layer and the dye receiving layer and subjected to a relative speed multiple-use printing procedure wherein the running speed of the dye transfer sheet relative to the thermal printing head was 1/5 of the speed of the dye receiving sheet relative to the head (i.e. n=5). As a result, stable running was ensured with a print density of 75% based on the print density attained by an ordinary single-use mode procedure.

Next, the synergistic effect of the diffusion rates of the dye in the dye transfer sheet and the dye receiving sheet and the concentration distribution of the dye in the dye transfer sheet was determined in the following examples.

EXAMPLE 17

A dye transfer sheet was the same as obtained in Example 1. A dye receiving sheet was the same as used in Example 4.

EXAMPLE 18

A dye transfer sheet was made by quickly applying onto the dye transfer layer of the sheet of Comparative Example 2 a solution of a polysulfone resin as used in the dye transfer layer in a dry thickness of 0.2 micrometers and dried, thereby forming a dye-permeable sub-layer.

The dye receiving sheet used was the same as obtained in Example 1.

EXAMPLE 19

A dye transfer sheet was made by quickly applying onto the dye transfer layer of the sheet of Example 1 a solution of a butyral resin as used in the dye transfer layer in a dry thickness of 0.2 micrometers and dried, thereby forming a dye-permeable sub-layer.

The dye receiving sheet used was the same as obtained in Example 4.

EXAMPLE 20

A dye transfer sheet was made in the same manner as in Example 1 except that an ink composition comprised of 5 g of the dye and 3 g of the butyral resin was used to form a dye transfer layer in an amount of the dye of 2.0 g/m$^2$, followed by further forming a dye-permeable sub-layer in the same manner as in Example 19 and that 5 wt % of a lubricant made of paraffin wax having a melting point of 50° C. and oleic acid amide at a mixing ratio by weight of 1:1 was added to each of the lower and upper sub-layers.

The dye receiving sheet used was the same as used in Example 7.

Figure 7:
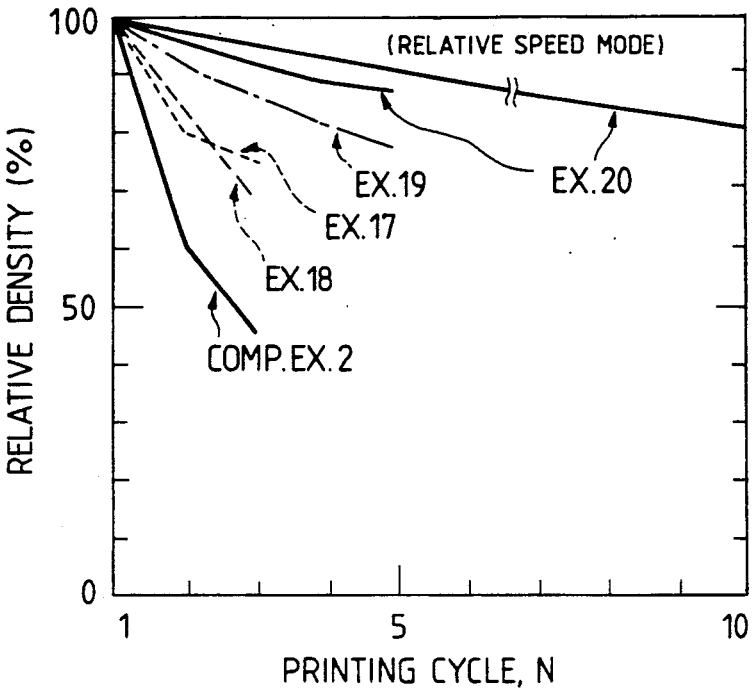
FIGS. 7, 8 and 9 are, respectively, graphs showing the relation between the printing density characteristic and the printing cycles.

The combinations of the dye transfer sheet and the dye receiving sheets of Examples 17 to 20 and Comparative Example 2 were subjected to a simple repetition multiple-use printing procedure at the same level of printing energy to determine a variation in printing density (%)=printing density at the Nth cycle/printing density at the first cycle and also to a relative speed printing procedure for the combination of Example 20 to determined a variation in printing density (%)=n-times mode printing density/ordinary or single-use mode printing density (first printing density). The printing energy was so controlled that the printing density at the first cycle was about 2.0. The results are shown in FIG. 7. These results reveal the excellence of the combinations of the invention.

Formation of lubricating reaction products of at least two reactive silicone oils each having a plurality of reactive functional groups in one molecule on the surface of a dye transfer layer is particularly described.

The fundamental printing conditions using a thermal printing head are as follows.

Printing cycle—16.7 ms/l
Printing pulse width—4.0 ms (max)
Resolution—6 l/mm
Printing energy—about 6 J/cm$^2$ (variable)
Running speed of dye transfer sheet—1.0 mm/second
Running speed of dye receiving sheet—10.0 mm/second

EXAMPLE 21

An ink composition comprised of 2 g of the dye indicated before and 2 g of a butyral resin (S-Lek BX-1, available from Sekisui Chem. Co., Ltd.) dissolved in a mixed solvent of 21 g of toluene and 9 g of methyl ethyl ketone was applied onto the substrate by means of a wire bar in an amount of 3 g/m$^2$ on the dry basis and dried to form a sub-layer having a higher concentration of the dye. Thereafter, a coating composition comprised of 1 g of a water-soluble polyester resin (Polyester WR901, available from The Nippon Synthetic Chem. Ind. Co., Ltd.) and 0.1 g of polyvinyl alcohol (Gosenol KH-17, available from The Nippon Synthetic Chem. Ind. Co., Ltd.) dissolved in 20 g of water was applied onto the first sub-layer by means of a wire bar in an amount of 0.2 g/m$^2$ on the dry basis and dried to form a dye-permeable sub-layer free of the dye. Subsequently, a coating solution comprised of 1 g of a butyral resin (BMS), 0.05 g of an amino-modified silicone oil (KF393, available from Shin-etsu Chem. Co., Ltd.) and 0.05 g of an epoxy-modified silicone oil (X-22-393, available from Shin-etsu Chem. Co., Ltd.) dissolved in 15 g of toluene was applied onto the second sub-layer in an amount of 0.2 g/m$^2$ on the dry basis, and dried to obtain a dye transfer sheet. Taking into account a reaction time for the amino-modified silicone oil and the epoxy-modified silicone oil, the sheet was used for printing 48 hours after the fabrication.

EXAMPLE 22

The general procedure of Example 21 was repeated thereby forming the first and second sub-layers, followed by applying a coating composition comprised of 1 g of butyral resin (BMS), 0.05 of an epoxy-modified silicone oil (T-29, available from Nippon Unicar Co., Ltd.) and 0.05 g of a carboxyl-modified silicone oil (FZ-3703, available from Nippon Unicar Co., Ltd.) dissolved in 15 g of toluene by means of a wire bar in an amount of 0.2 g/m$^2$ on the dry basis and drying to obtain a dye transfer sheet. Taking into account a reaction time for the carboxyl-modified silicone oil and the epoxy-modified silicone oil, the sheet was used for printing 48 hours after the fabrication.

EXAMPLE 23

An ink composition comprised of 2 g of the dye indicated before, 2 g of a butyral resin (S-Lek BX-1, Sekisui Chem. Co., Ltd.) as a binder resin, 0.2 g of an epoxy-modified silicone oil (T-29) and 0.2 g of an amino-modified silicone oil (FZ-3705) dissolved in a mixed solvent of 21 g of toluene and 9 g of methyl ethyl ketone was applied onto the substrate indicated before by means of a wire bar in an amount of 3 g/m$^2$ on the dry basis and gradually dried with hot air at 100° C. to obtain a dye transfer sheet.

REFERENCE

Example 21 was repeated without formation of the lubricant layer, thereby obtaining a dye transfer sheet.

The dye transfer sheet obtained in these examples and reference were used for printing under conditions indicated before to check whether or not the sheets were usable for relative speed printing. The results are shown in Table 4.

TABLE 4

| | Results of Relative Speed Printing |
|---|---|
| Example 21 | possible to an extent of a maximum printing pulse width of 4 ms |
| Example 22 | possible to an extent of a maximum printing pulse width of 4 ms |
| Example 23 | possible to an extent of a maximum printing pulse width of 4 ms |
| Reference | sticked at a pulse width of 1.5 ms |

The case where the dye transfer layer has a double layer construction of a first sub-layer having a higher concentration of dye and a second sub-layer which has a lower concentration of dye or is free of the dye and is formed of at least a water-soluble or dispersable resin is described.

Fundamental printing conditions using a thermal printing head are as follows.

Printing cycle—16.7 ms/l
Printing pulse width—4.0 ms (max)
Resolution—6 l/mm
Printing energy—6 J/cm$^2$ (variable)
Running speed of dye transfer sheet—1.0 mm/second*
Running speed of dye receiving sheet—10.0 mm/second

*The above running speed is only for the relative speed printing mode. For the simple repetition printing procedure, the running speed is 10.0 mm/second.

EXAMPLE 24

An ink composition comprised of 2 g of the dye indicated before and 2 g of a butyral resin (S-Lek BX-1, available from Sekisui Chem. Co., Ltd.) used as a binder resin dissolved in a mixed solvent of 21 g of toluene and 9 g of methyl ethyl ketone was applied onto the substrate indicated before by means of a wire bar in an amount of 3 g/m$^2$ on the dry basis and dried to obtain a first sub-layer containing the dye. Thereafter, a coating composition comprising 1 g of a water-soluble saturated polyester resin (Polyester WR901, available from The Nippon Synthetic Chem. Ind. Co., Ltd.) and 0.1 g of polyvinyl alcohol (Gosenol KH-17, The Nippon Synthetic Chem. Ind., Co., Ltd.) dissolved in 20 g of water was applied onto the first sub-layer by means of a wire bar in an amount of 0.2 g/m$^2$ on the dry basis and dried to form a second sub-layer free of any dye. A coating solution of 1 g of a butyral resin (Eslek BMS, available from Sekisui Chem. Co., Ltd.), 0.05 g of paraffin wax having a melting point of 69° C. (No. 155, available from Nippon Seiro Co., Ltd.) and 0.05 g of oleic acid amide dissolved in 15 g of toluene was further applied onto the second sub-layer by means of a wire bar in an amount of 0.2 g/m$^2$ on the dry basis and dried to form a lubricant layer. Thus, a dye transfer sheet was obtained.

EXAMPLE 25

The first sub-layer was formed in the same manner as in Example 24, followed by further application of a coating composition of 1 g of polyvinyl alcohol having a degree of saponification of 45% dissolved in a mixed solvent of 7.5 g of water and 7.5 g of ethanol in an amount of 0.2 g/m$^2$ on the dry basis and dried to obtain a dye transfer sheet.

EXAMPLE 26

The first sub-layer was formed in the same manner as in Example 24, followed by further application of a coating composition of 5 g of an aqueous solution of a water-dispersable urethane ionomer resin (Hydran AP40 with a solid content of 22 wt %, available from Dainippon Ink & Chemicals Co., Ltd.) and 0.02 g of polyvinyl alcohol having a degree of saponification of 78.5 to 81.5% (Gosenol KH-17, available from The Nippon Synthetic Chem. Ind. Co., Ltd.) dispersed and dissolved in 12.5 g of water was applied onto the first sub-layer in an amount of 0.2 g/m$^2$ on the dry basis and dried to from a second sub-layer free of dye. Moreover, a lubricant composition comprised of 1 g of a butyral resin (BMS), 0.05 g of an amino-modified silicone oil (KF393, available from Shin-etsu Chem. Co., Ltd.) and 0.05 g of an epoxy-modified silicone oil (X-22-393, available from Shin-etsu Chem. Co., Ltd.) dissolved in 15 g of toluene was similarly applied and dried to obtain a dye transfer sheet.

EXAMPLE 27

A first sub-layer was formed in the same manner as in Example 24, after which a lubricant composition comprised of 1 g of polyvinyl alcohol having a degree of saponification of 45%, 0.05 g of paraffin wax having a melting point of 69° C., 0.05 g of oleic acid amide and 0.002 g of a surface active agent (Rheodol, available from Kao Corp.) dissolved and emulsified in a mixed solvent of 7.5 g of water and 7.5 g of ethanol was applied in an amount of 0.2 g/m$^2$ on the dry basis and dried to obtain a dye transfer sheet.

COMPARATIVE EXAMPLE 6

A first sub-layer alone as in Example 24 was formed on the substrate indicated before to obtain a dye transfer sheet.

COMPARATIVE EXAMPLE 7

A first sub-layer having dye contained therein was formed in the same manner as in Example 24, after which a non-aqueous coating composition comprised of 1 g of a butyral resin (BX-1), 0.05 g of paraffin wax having a melting point of 69° C. and 0.05 g of oleic acid amide dissolved in a mixed solvent of 21 g of toluene and 9 g of methyl ethyl ketone (MEK) was applied onto the first sub-layer by means of a wire bar in an amount of 0.8 g/m$^2$ and dried to form a dye-permeable second sub-layer free of the dye to obtain a dye transfer sheet. It was found that after the application of the second sub-layer, the wire bar was attached with the dye dissolved with the non-aqueous composition.

EXAMPLE 28

A first sub-layer was formed in the same manner as in Example 24 using the dye, after which an aqueous coating solution of 1 g of polyvinyl alcohol having a degree of saponification of 99% (Poval 117, available from Kuraray Co., Ltd.) dissolved in 20 g of water was applied in an amount of 0.1 g/m$^2$ on the dry basis to form a second sub-layer free of dye. Thereafter, a lubricant composition comprised of 1 g of butyral resin (BMS), 0.05 g of an amino-modified silicone oil (KF393, available from Shin-etsu Chem. Co., Ltd.) and an epoxy-modified silicone oil (X-22-393, available from Shin-etsu Chem. Co., Ltd.) dissolved in 15 g of toluene was applied in the same manner as set forth above and dried to obtain a dye transfer sheet.

The dye transfer sheets obtained in these examples and comparative examples were each subjected to a relative speed printing procedure under conditions indicated before to determine whether the respective sheets could be used for the relative speed printing. The results are shown in Table 5. In the table, the printing energy is intended to mean the energy required to give a printing density of about 1.8.

Figure 8:
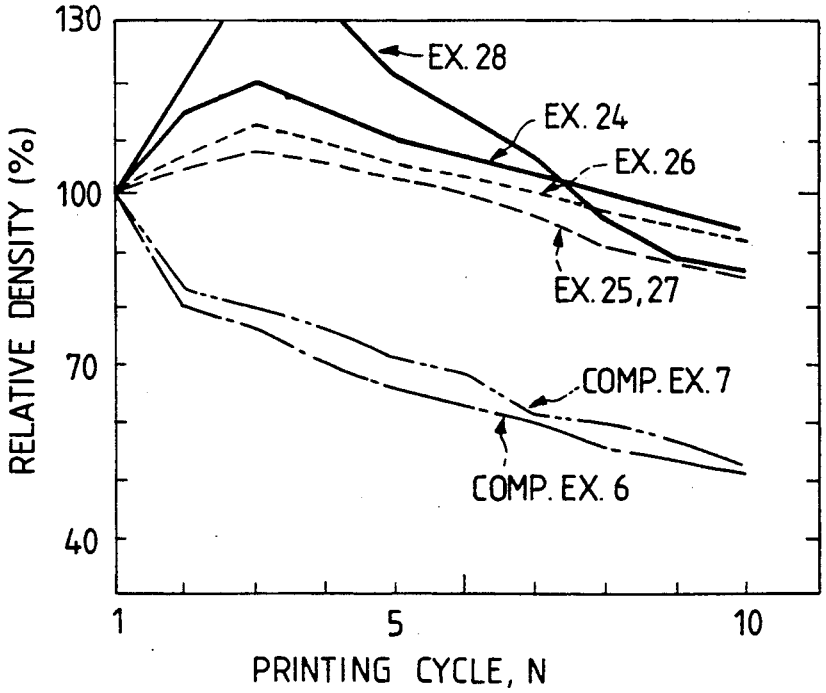

Also, the sheets were subjected to a simple repetition multiple-use printing procedure at the same level of the printing energy to determine a variation in printing density which is a ratio by % of printing density at the Nth printing cycle/printing density at the first cycle. The results are shown in FIG. 8.

TABLE 5

| | Printing Energy (J/cm$^2$) | Multiple-use Characteristics | Possibility of Relative Speed Printing |
|---|---|---|---|
| Example 24 | 6.0 | good | yes |
| Example 25 | 6.0 | good | no |
| Example 26 | 6.0 | good | yes |
| Example 27 | 6.0 | good | yes |
| Example 28 | 7.6 | good | yes |
| Comp. Ex. 6 | 4.5 | poor | no |
| Comp. Ex. 7 | 5.0 | poor | yes |

In the following examples, introduction of linear hydrocarbon derivatives having 12 or more carbon atoms by reaction with resins contained in a dye transfer layer is described.

Printing was effected under the following conditions.

Printing cycle—16.7 ms/l

Printing pulse width—4.0 ms (max)

Resolution—6 l/mm

Printing energy—6 J/cm$^2$ (variable)

Running speed of dye transfer sheet—1.0 mm/second*

Running speed of dye receiving sheet—10.0 mm/second

EXAMPLE 29

An ink composition comprised of 2 g of the dye indicated before and 2 g of a butyral resin (S-Lek BX-1, available from Sekisui Chem. Co., Ltd.) dissolved in a mixed solvent of 21 g and 9 g of methyl ethyl ketone was applied onto the substrate set forth before by means of a wire bar in an amount of 3 g/m$^2$ on the dry basis and dried to form a first sub-layer containing the dye. A coating composition of 1 g of partially saponified polyvinyl alcohol (Poval 420, available from Kuraray Co., Ltd.) dissolved in 20 g of water was applied onto the first sub-layer in an amount of 0.15 g/m$^2$ on the dry basis and dried to form a second sub-layer serving as a dye-permeable, dye-free layer thereby obtaining a dye transfer layer. Thereafter, a solution of 1 g of stearic acid chloride in petroleum benzine was sprayed over the second sub-layer by the use of a portable sprayer until the surface was sufficiently wetted and dried. After allowing to stand for 1 minute, the surface was wiped with non-woven fabric cloth impregnated with petroleum benzine thereby removing side products. Thus, a dye transfer sheet was obtained.

EXAMPLE 30

A first sub-layer was formed in the same manner as in Example 29, after which a coating composition of 1 g of polyvinyl alcohol having a degree of saponification of 45% dissolved in a mixed solvent of 7.5 g of water and 7.5 g of ethanol was applied onto the first sub-layer in an amount of 0.2 g/m$^2$ on the dry basis and dried to form a second sub-layer free of dye thereby obtaining a dye transfer layer. A solution of 1 g of lauryl trichlorosilane dissolved in 100 g of octane was sprayed over the dye transfer layer by the use of a portable sprayer until the layer surface was sufficiently wetted, and dried. After allowing the wetted layer to stand for 1 hour, the surface was wiped with non-woven fabric cloth impregnated with petroleum benzine thereby removing side products. Thus, a dye transfer sheet was obtained.

EXAMPLE 31

A first sub-layer was formed in the same manner as in Example 29, after which a coating composition of 1 g of a copolymer of methyl acrylate and glycidyl methacrylate at a molar ratio of 1:4 dissolved in 20 g of toluene was quickly applied onto the first sub-layer in an amount of 0.8 g/m$^2$ on the dry basis and dried to form a second sub-layer free of dye thereby obtaining a dye transfer layer. A solution of 1 g of oleylamine dissolved in 100 g of ethanol was sprayed over the dye transfer layer by the use of a portable sprayer until the layer surface was sufficiently wetted, and dried. After allowing the wetted layer to stand for 2 days, the surface was wiped with non-woven fabric cloth impregnated with methanol thereby removing unreacted matters. Thus, a dye transfer sheet was obtained.

COMPARATIVE EXAMPLE 8

In the same manner as in Example 29, first and second sub-layers were formed to obtain a dye transfer sheet.

Figure 9:
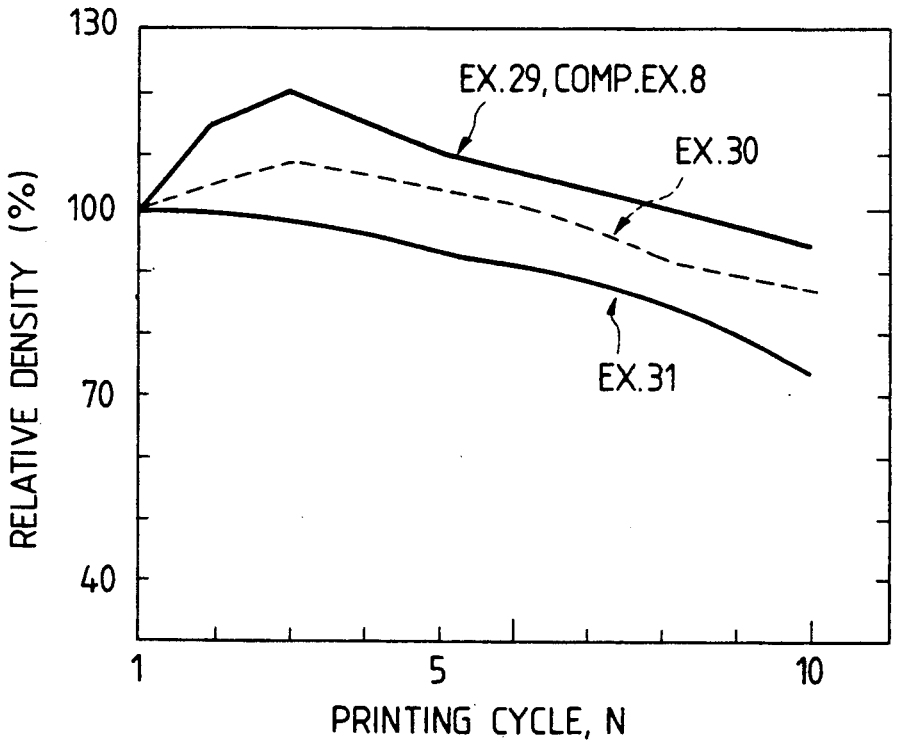

The dye transfer sheets obtained in these examples and comparative examples were subjected to printing under the conditions indicated before to determine whether such sheets could be used for the relative speed printing procedure. The results are shown in Table 6. The respective sheets were also subjected to a simple repetition multiple-use printing procedure at the same level of printing energy to measure a variation in printing density which is expressed as a ratio by % of printing density at the Nth cycle/printing density at the first cycle. The results are shown in FIG. 9.

TABLE 6

| | Printing Energy ($J/cm^2$) | Multiple-use Characteristics | Possibility of Relative Speed Printing |
|---|---|---|---|
| Example 29 | 7.0 | good | yes |
| Example 30 | 6.0 | good | no |
| Example 31 | 6.0 | good | yes |
| Comp. Ex. 8 | 4.5 | poor | no |

The printing energy means an energy required to give a printing density of about 1.8.

What is claimed is:

1. A method for thermal dye transfer printing which comprises providing a dye transfer sheet having a substrate and a dye transfer layer formed on the substrate and comprised of a sublimable dye and a binder resin wherein the concentration by weight of the sublimable dye in the layer is lower at the surface side of the layer than at the side contacting the substrate and a dye receiving sheet having on a substrate a dye receiving layer capable of receiving the sublimable dye of an imagewise pattern from the dye transfer sheet;

contacting the dye transfer sheet and the dye receiving sheet so that the dye transfer layer and the dye receiving layer are facing each other;

heating the contacted sheets in an imagewise pattern to permit the sublimable dye to transfer to the dye receiving layer according to the imagewise pattern to form an image on the dye receiving sheet; and repeating the above contacting and heating steps for a plurality of subsequent printing operation cycles wherein the dye transfer layer is reused for subsequent printing on fresh dye receiving sheets whereby the dye transfer layer is repeatedly used plural times at any arbitrary portions thereof.

2. The method according to claim 1, wherein the contacted sheets are heated from a layer-free side of either the dye transfer sheet or the dye receiving sheet.

3. The method according to claim 1, wherein when heated, said dye transfer sheet is run at a speed, relative to a thermal printing head, smaller than said dye receiving sheet.

4. The method according to claim 1, wherein said dye receiving layer is arranged to have a diffusion rate of the sublimable dye therethrough smaller than a diffusion rate of the sublimable dye into the dye transfer layer.

5. A thermal dye transfer printing system which comprises a dye transfer sheet which is used in combination with a dye receiving sheet, said dye transfer sheet comprising a substrate and a dye transfer layer formed on the substrate and comprised of a sublimable dye and a binder resin in such a way that the content by weight of the sublimable dye in the dye transfer layer is lower at the surface side thereof than at the side contacting the substrate.

6. The thermal dye transfer printing system according to claim 5, wherein said dye transfer layer is made of a plurality of sub-layers having different contents of the dye which are superposed on the substrate in the order of a higher concentration of the dye from the side contacting the substrate.

7. The thermal dye transfer printing system according to claim 6, wherein said dye transfer layer is made of two sub-layers, one of sub-layers containing at least the dye and formed directly on the substrate, the other sub-layer having a content of the dye less than the first-mentioned sub-layer and formed thereon.

8. The thermal dye transfer printing system according to claim 7, wherein the other sub-layer has a content of the dye not larger than half the content in the first-mentioned sub-layer.

9. The thermal dye transfer printing system according to claim 7, wherein the other sub-layer is substantially free of the dye.

10. The thermal dye transfer printing system according to claim 7, wherein the other sub-layer is made of a water-soluble or dispersable resin.

11. The thermal dye transfer printing system according to claim 10, wherein said water-soluble or dispersable resin is a partially saponified polyvinyl alcohol resin, a water-soluble saturated polyester resin or a water-dispersable polyurethane resin.

12. The thermal dye transfer printing system according to claim 11, wherein said water-soluble or dispersable resin is a partially saponified polyvinyl alcohol resin having a degree of saponification of from 30 to 90%.

13. The thermal dye transfer printing system according to claim 7, wherein said dye transfer layer is a double layer construction which is obtained by applying a non-aqueous coating solution containing the sublimable dye onto the substrate and drying the applied solution to form a first sub-layer and further applying an aqueous coating comprising a water-soluble or dispersable resin onto the first sub-layer and drying the aqueous coating to form a second sub-layer wherein said second sub-layer contains the sublimable dye at a concentration by weight smaller than said first sub-layer.

14. The thermal dye transfer printing system according to claim 13, wherein said second sub-layer is substantially free of the dye.

15. The thermal dye transfer printing system according to claim 7, wherein the other sub-layer further comprises a lubricant.

16. The thermal dye transfer printing system according to claim 7, further comprising a layer comprising at least a lubricant on the other sub-layer.

17. The thermal dye transfer printing system according to claim 16, wherein said lubricant is a reaction product of at least two reactive silicone oils each having a plurality of reactive functional groups in one molecule.

18. The thermal dye transfer printing system according to claim 17, wherein said reaction product is a product of an epoxy-modified silicone oil and an amino-modified silicone oil.

19. The thermal dye transfer printing system according to claim 5, wherein the dye in the surface of said dye transfer layer is removed so that the content of the sublimable dye at the surface side becomes lower than at the side contacting the substrate.

20. The thermal dye transfer printing system according to claim 9, wherein said dye receiving sheet has a dye receiving layer which has a diffusion rate of the dye smaller than said dye transfer layer.

21. The thermal dye transfer printing system according to claim 20, wherein said dye receiving layer comprises at least 25 wt % of a cured resin.

22. The thermal dye transfer printing system according to claim 21, wherein said dye receiving layer is made of a cured resin.

23. The thermal dye transfer printing system according to claim 5, wherein said dye transfer layer comprises a resin having reactive functional groups, which are reacted with a linear hydrocarbon derivative having functional groups reactive with the reactive functional groups of the resin and having not less than 12 carbon atoms, thereby forming a layer of linear hydrocarbon groups on the surface of said dye transfer layer.

24. The thermal dye transfer printing system according to claim 23, wherein said resin has hydroxyl groups or glycidyl groups and said linear hydrocarbon derivative is a member selected from the group consisting of acid chlorides, di or trichlorosilanes and amines and alkoxysilanes and amines each having a hydrocarbon group with not less than 12 carbon atoms.

25. The thermal dye transfer printing system according to claim 24, wherein said linear hydrocarbon derivative is lauric acid chloride, stearic acid chloride, erucic acid chloride, oleic acid chloride, lauryl trichlorosilane, stearyl trichlorosilane, laurylamine, stearylamine or oleylamine.

26. The thermal dye transfer printing system according to claim 23, wherein said resin further comprises not less than 30 mole % of a vinyl alcohol, glycidyl acrylate or glycidyl methacrylate monomer.

* * * * *